United States Patent [19]

Christensen

[11] Patent Number: 4,749,037

[45] Date of Patent: Jun. 7, 1988

[54] STRING BYPASS

[75] Inventor: Jon B. Christensen, Duncan, Okla.

[73] Assignee: Halliburton Company, Duncan, Okla.

[21] Appl. No.: 922,000

[22] Filed: Oct. 22, 1986

[51] Int. Cl.[4] ..... E21B 23/06; E21B 34/06

[52] U.S. Cl. ..... 166/184; 166/131; 166/319

[58] Field of Search ..... 166/101, 106, 115, 116, 166/141, 148, 149, 151, 184, 185, 187, 191, 128, 131, 121, 124, 319, 373

[56] References Cited

U.S. PATENT DOCUMENTS

| | | | |
|---|---|---|---|
| 2,775,305 | 12/1956 | McKinley | 166/149 |
| 3,158,200 | 11/1964 | Malone | 166/106 |
| 3,412,799 | 11/1968 | Ellis | 166/131 X |
| 3,439,740 | 4/1969 | Conover | 166/250 |
| 3,876,000 | 4/1975 | Nutter | 166/106 |
| 3,876,003 | 4/1975 | Kisling, III | 166/250 |
| 3,926,254 | 12/1975 | Evans et al. | 166/106 |
| 4,246,964 | 1/1981 | Brandell | 166/106 |
| 4,320,800 | 3/1982 | Upchurch | 166/106 |
| 4,366,862 | 1/1983 | Brandell | 166/106 |
| 4,372,387 | 2/1983 | Brandell | 166/334 |
| 4,386,655 | 6/1983 | Brandell | 166/106 |
| 4,388,968 | 6/1983 | Brandell | 166/236 |
| 4,412,584 | 11/1983 | Brandell | 166/169 |
| 4,457,367 | 7/1984 | Brandell | 166/105 |
| 4,458,752 | 7/1984 | Brandell | 166/187 |
| 4,580,632 | 4/1986 | Reardon | 166/191 X |

OTHER PUBLICATIONS

*Oilweek*, Sep. 1, 1980, edition, p. 11—Northstar Drill-stem Testers, Ltd.

*Primary Examiner*—George A. Suchfield
*Assistant Examiner*—David J. Bagnell
*Attorney, Agent, or Firm*—James R. Duzan; Neal R. Kennedy

[57] ABSTRACT

A string bypass for bypassing fluid around a packer as a testing string is lowered into or raised out of a well bore. The string bypass includes an outer case with an inner mandrel positioned therein such that an annular cavity is defined therebetween. A reciprocating piston is positioned in the annular cavity. The case and mandrel both define transverse holes therethrough, and the piston includes a transverse passageway which provides intercommunication between the holes when the piston is in an open position. A spring biases the piston toward the open position. A pump is used to inflate the packer, and, as the pump pressure gradually increases, a differential between the pump pressure and well annulus pressure acts against an annular area on the piston and overcomes the spring force so that the piston is moved to a sealed, closed position in which communication between the holes is prevented. The piston also includes a substantially longitudinal passageway therethrough which provides continuous fluid communication between the pump above the string bypass and the packer below the string bypass.

20 Claims, 2 Drawing Sheets

STRING BYPASS

BACKGROUND OF THE INVENTION

1. Field Of The Invention

The present invention relates to tools for bypassing fluid around a packer when a tool string is being run into, or removed from, a well bore, a more particularly, to a string bypass which is opened and closed responsive to pressure from a pump used to inflate the packer.

2. Description Of The Prior Art

When a tool string with a packer is lowered into a well bore, or removed therefrom, a problem arises because the packer, even when deflated or unactuated, is usually in relatively closer proximitity to the well bore than the other components of the tool string. As the tool string is moved longitudinally through the fluid in the well bore, the packer acts as a ram which does not allow a high flow rate of fluid therearound. This results in a much slower trip into or out of the well bore. To avoid this problem, bypass devices have been put in tool strings for allowing fluid to enter a portion of the tool string below the packer and exit a portion of the tool string above the packer. When the tool string is removed, the flow is reversed. Because fluid flows through this passageway rather than around the packer, there is less restriction as the tool string is moved through the well bore, and thus a much quicker trip is possible.

In many cases, it is undesirable to have such a bypass device open all of the time, and this is particularly true in testing tool strings which are used to test specific well formations. In such testing strings, normally a pair of inflatable packer are used with a flow port therebetween which is positioned adjacent the formation. The packers are inflated by a pump which is positioned in the testing string above packers and which pumps well annulus fluid or mud into the packers to place them in sealing engagement with the well bore. When running the testing string into the well bore, it is desirable to bypass fluid around the top packer through the flow port between the packers. However, this bypassing must be prevented when actually testing the fluids in the well formation. In other words, intercommunication between the formation to be tested and the well annulus above the top packer must be prevented during a testing operation. Thus, any string bypass for bypassing around the top packer must be closable prior to testing once the testing string is in position and the packers are inflated.

A mechanically actuated device which has been used as such a closable string bypass is the Halliburton "VR Safety Joint". The bypass is opened and closed by raising and lowering the tool string which results in relative longitudinal movement between an inner mandrel and an outer case in the safety joint. When the case and mandrel are relatively extended, the bypass is opened, and when the mandrel and case are moved relatively toward one another, the bypass is closed.

Problems result in usage of this manually actuated bypass, and one such situation may occur when the tool string encounters a tight spot in the well bore. This may result in the packers dragging on the tight spot with a resultant upward force on the packers causing the upper portion of the tool string to move relatively downward, thus shutting the bypass ports. When this occurs, bypassing is stopped, and the ram effect is once again a problem.

Another problem with the manually actuated bypass is that the testing string must be raised and lowered during the testing operation to actuate the tester valve and perhaps other components in the testing string. During testing, the bypass must be closed, and it is possible that during some of these raising and lowering operations, the bypass may be inadvertently opened which will dump well annulus hydrostatic pressure on the formation, ruining the test.

The string bypass of the present invention does not require any manual manipulation. Instead, a valve means is used which is closed in response to a differential pressure between the pump discharge and the well annulus. The bypass cannot be closed accidentally when running the testing string into the well bore. Also, the bypass cannot be inadvertently opened by manipulation of the tool string. The valve will only open to the bypassing position when the pressure between the pump discharge and the packers is relieved. In the system herein, this takes approximately 10,000 pounds pull at the surface which is considerably more than is required to manipulate the testing string during normal testing operations.

SUMMARY OF THE INVENTION

The string bypass of the present invention is adapted for bypassing around a packer in a testing string or apparatus. The string bypass comprises case means positionable in the testing string between a pump and an inflatable packer and valve means reciprocably disposed in the case means. The case means defines a transverse port therein, and the valve means includes first passageway means thereon. The valve means is movable between an open position and a closed position, the open position providing communication between a central bore of the testing string and a well annulus through the port in the case means and through the first passageway means. When the valve means is in the closed position, communication between the central bore of the testing string and the well annulus is prevented. The string bypass further comprises second passageway means for providing substantially continuous communication between the pump and packer.

The string bypass also preferably comprises mandrel means disposed in the case means such that an annular cavity is defined therebetween, wherein the valve means is annularly disposed in the cavity.

In the preferred embodiment, the valve means comprises a reciprocating piston and biasing means for biasing the piston toward the open position of the valve means. The piston and case means define a chamber therebetween in which the biasing means, such as a spring, is disposed. Shoulder means limit movement of the piston.

The case means further includes an additional port in communication with the chamber for venting th chamber to the well annulus as the piston is moved from the open to the closed position. Sealing means are provided for sealingly separating the chamber from the first and second passageway means.

The piston also comprises an annular area thereon, and the piston is moved from the open position to the closed position of the valve means when force exerted by a differential between the pump pressure and well annulus pressure across the annular area is greater than a force exerted by the biasing means.

Also in the preferred embodiment, the first passageway means is a substantially transverse passageway means through the piston. The second passageway means is a substantially longitudinal passageway means through the piston. Sealing means are provided for sealingly separating the first and seond passageway means.

An important object of the present invention is to provide a pressure actuated string bypass for bypassing around a packer in a testing string.

Another object of the invention is to provide a string bypass with valve means which is responsive to a pressure differential between a packer inflation pump and the well annulus.

A further object of the invention is to provide a string bypass which has a longitudinal passageway therethrough providing continuous communication between the pump and the packers.

Still another object of the invention is to provide a string bypass with a spring biased piston therein.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1A:
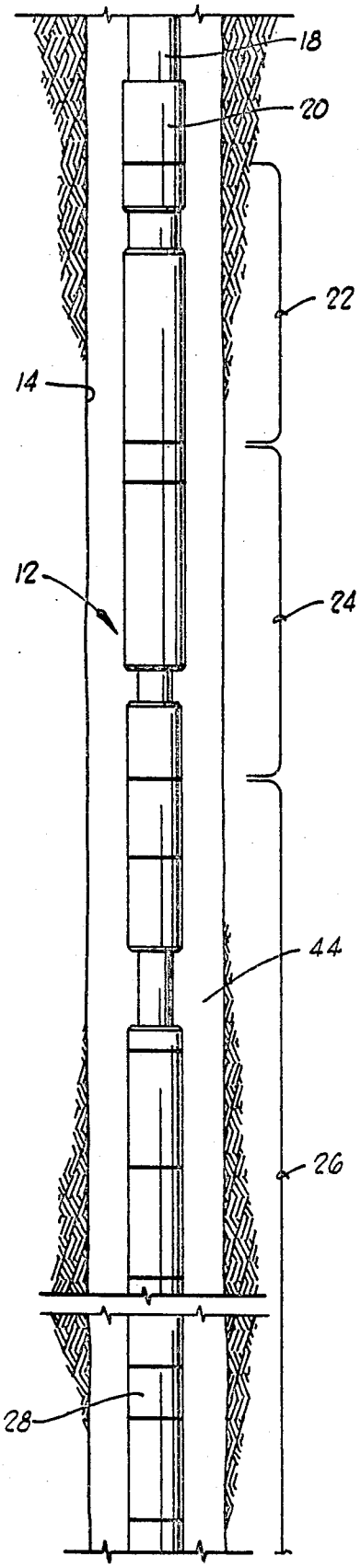
FIGS. 1A–1B show the string bypass of the present invention as part of a testing string in position in a well bore for testing a well formation.
Figure 1B:
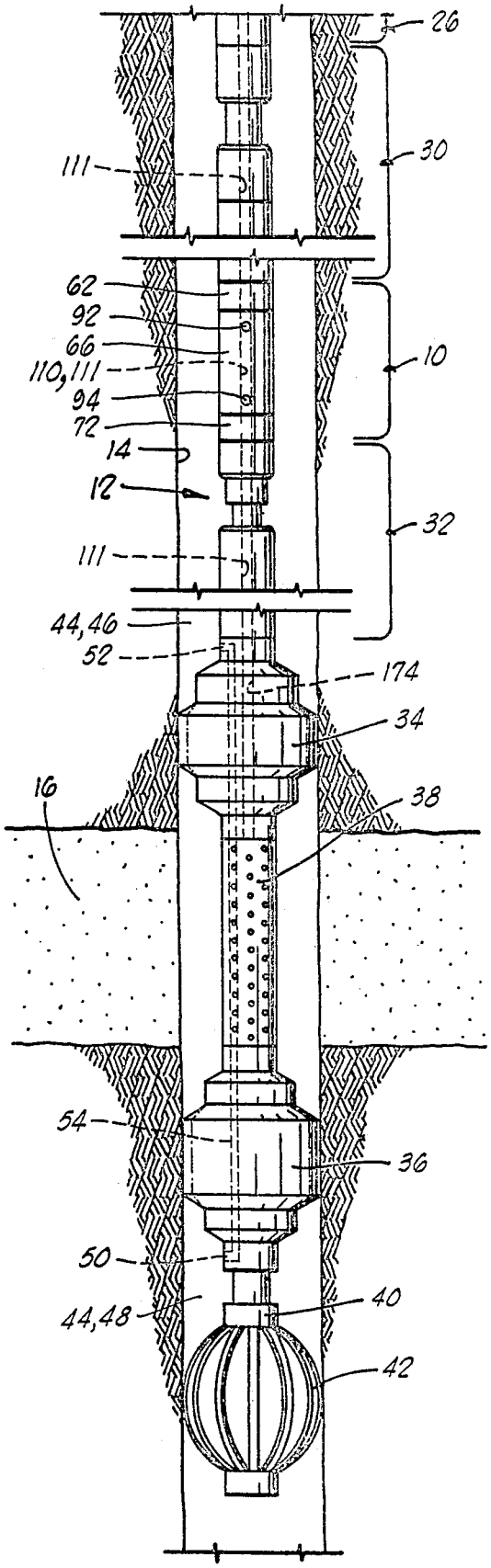

Referring now to the drawings, and more particularly to FIGS. 1A–1B, the string bypass of the present invention is shown and generally designated by the numeral 10. String bypass 10 forms a part of a testing apparatus or tool 12. Testing apparatus 12 is shown in position in a well bore 14 for use in testing a well formation 16.

Testing apparatus 12 is attached to the lower end of a tool or testing string 18 and includes a reversing sub 20, a tester valve 22 such as the Halliburton Hydrospring® tester, an extension joint 24, a pump 26 of a type having pressure limiter means 28 forming a part thereof, and a packer bypass 30, all of which are positioned above string bypass 10.

Disposed below string bypass 10 is a safety joint 32, such as the Halliburton Hydroflate® safety joint. An upper packer 34 is attached to the lower end of safety joint 32 and is disposed above well formation 16. A lower packer 36 is positioned below well formation 16. A porting sub 38 interconnects upper packer 34 and lower packer 36. Spacers (not shown) may also be used between upper packer 34 and lower packer 36 depending upon the longitudinal separation required therebetween.

Pump 26 is preferably a positive displacement pump and is used to inflate upper packer 34 and lower packer 36 in a manner known in the art such that the packers may be placed in sealing engagement with well bore 14, thus isolating well formation 16 as shown in FIGS. 1A–1B so that a testing operation may be carried out.

Packer bypass 30 is used to relieve pressure in packers 34 and 36 for deflation thereof after the testing operation. Preferably, packer bypass 30 requires a pull on tool string 18 of approximately 10,000 pounds to relieve the pressure.

A gauge carrier 40 is attached to the lower end of lower packer 36 and includes a plurality of drag springs 42 which are adapted to engage well bore 14 and prevent rotation of a portion of testing apparatus 12 during inflation of upper packer 34 and lower packer 36.

A well annulus 44 is defined between testing apparatus 12 and well bore 14, and when upper packer 34 and lower packer 36 are inflated into sealing engagement with well bore 14, it will be seen that well annulus 44 is divided into an upper portion 46 above upper packer 34 and a lower portion 48 below lower packer 36. Both upper portion 46 and lower portion 48 of well annulus 44 are sealingly separated from well formation 16 by the packers.

When tool string 18 and testing apparatus 12 are lowered into well bore 14 or raised therefrom, upper packer 34 and lower packer 38 are in a deflated position as indicated by phantom lines in FIGS. 1A–1B. However, even when the packer are deflated, the outside diameter of the packers is relatively closer to well bore 14 than the other components in testing apparatus 12 or tool string 18. Because of this close proximity of upper packer 34 and lower packer 36 to well bore 14, fluid resistance is encountered as testing apparatus 12 is lowered into, or raised from, the well bore. The result is a ram effect which causes tool string 18 to move slowly. Thus, it is desirable to bypass fluid through testing apparatus 12 and around packers 34 and 36 so that a trip into or out of well bore 14 may be accomplished more quickly. In other words, if fluid is allowed to freely flow from below the packers and discharged above the packers during a trip into the well, the resistance of the packers in the fluid is at least partially negated. Preferably, this bypassing is reversed during a trip out of the well.

Bypassing around lower packer 36 is accomplished in a relatively simple manner known in the art. Normally, there is a lower equalizing port 50 below lower packer 36 and an upper equalizing port 52 above upper packer 34. Interconnecting lower equalizing port 50 and upper equalizing port 52 is a generally longitudinally disposed equalizing passageway 54. As testing apparatus 12 is lowered into well bore 14, fluid is free to enter lower equalizing port 50, pass through equalizing passageway 54 and be discharged through upper equalizing port 52. This lower packer bypass means can be continuously open even during a testing operation, because no portion of the bypass means is in communication with well formation 16.

Because of well bore variations, it is desirable to provide separate upper bypass means around upper packer 34. However, bypassing fluid around upper packer 34 is more complicated, and requires a closable bypass means such as string bypass 10 of the present invention.

Figure 2:
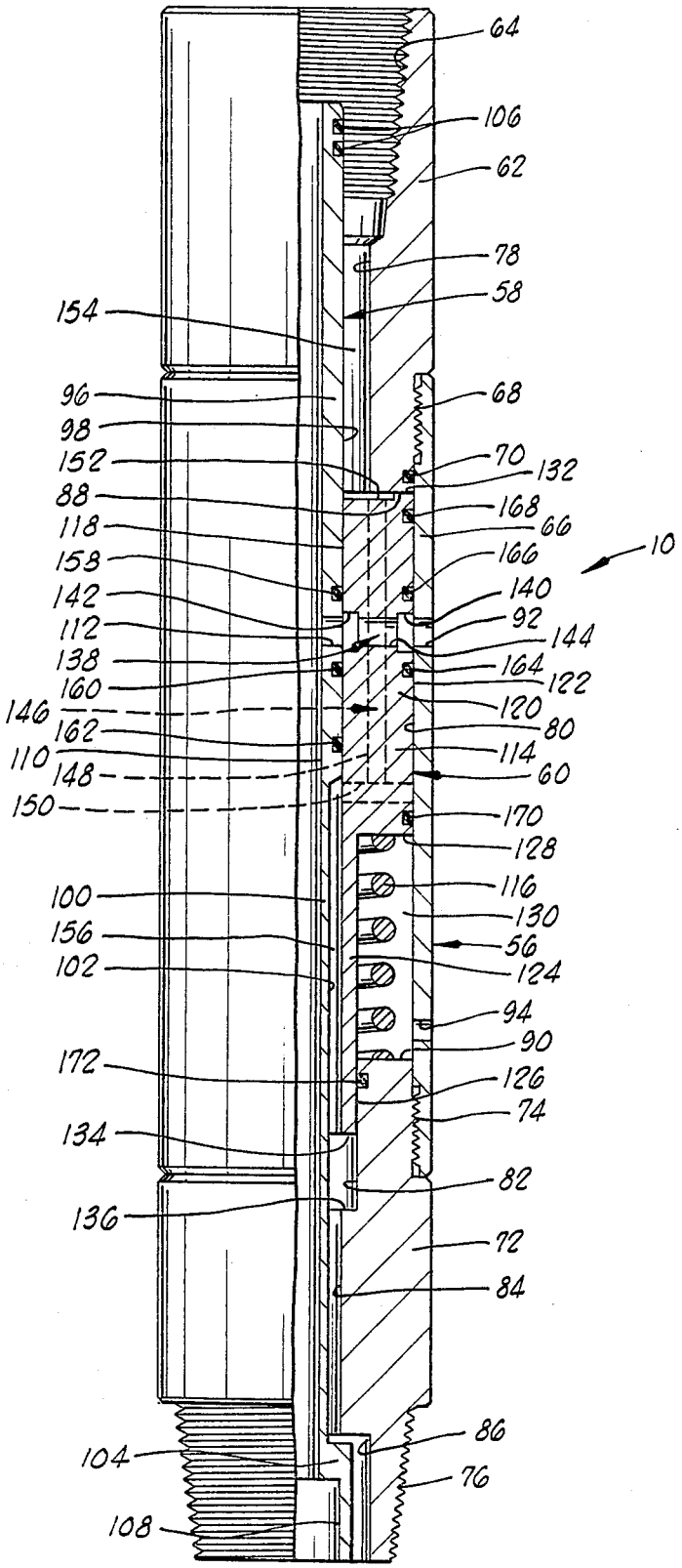
FIG. 2 shows a partial longitudinal cross section of the string bypass.

Referring now to FIG. 2, deails of string bypass 10 are shown. Generally, string bypass 10 comprises outer case means 56, inner mandrel means 58 disposed in case means 56, and valve means 60 annularly disposed between the mandrel means and case means.

Case means 56 includes an upper adapter 62 with internally threaded portion 64 for attachment to the components of testing apparatus 12 thereabove. The upper end of a piston case 66 is attached to upper adapter 62 at threaded connection 68. A seal 70 is provided between piston case 66 and upper adapter 62.

A lower adapter 72 is attached to the lower end of piston case 66 at threaded connection 74. An externally threaded lower portion 76 of lower adapter 72 is provided for attachment to the components of testing apparatus 12 positioned below string bypass 10.

Upper adapter 62 includes a central bore 78 therethrough, and piston case 66 has a substantially constant central bore 80 in communication with central bore 78. Lower adapter 72 includes a first bore 82 in communication with central bore 78 of piston case 66, a second bore 84 relatively smaller than first bore 82, and a third bore 86.

The lower end of upper adapter 62 forms a downwardly facing shoulder 88 in case means 56, and the upper end of lower adapter 72 forms an upwardly facing shoulder 90 in the case means generally opposite shoulder 88.

Extending substantially transversely through piston case 66 and longitudinally positioned between shoulders 88 and 89 are an upper transverse hole or port 92 and a lower transverse hole or port 94.

Mandrel means 58 is preferably in the form of an elongated mandrel having an upper portion 96 with an outer surface 98, an intermediate portion 100 having an outer surface 102 relatively smaller than outer surface 98 of the upper portion and a lower portion 104. Upper portion 96 of mandrel means 58 includes sealing means 106 thereon for sealingly engaging a corresponding mandrel (not shown) in the portion of testing apparatus 12 above string bypass 10. Lower portion 104 of mandrel means 58 defines a bore 108 therein adapted for receiving a corresponding mandrel (not shown) of the portion of testing apparatus 12 below string bypass 10. Mandrel means 58 further defines a central bore 110 therethrough, and the portions of testing apparatus 12 above and below mandrel means 58 form a substantially continuous central flow passageway 111, indicated in FIG. 1B, through testing apparatus 12 of which central bore 110 is a part. These upper and lower mandrel portions in testing apparatus 12 are generally of a kind known in the art.

Upper portion 96 of mandrel means 58 defines a transverse hole or port 112 therethrough. It will be seen that transverse hole 112 in mandrel means 58 is in substantially the same transverse plane as upper transverse hole 92 of case means 56. As will become more clear herein, it is not necessary for hole 112 to be coaxial with hole 92, but it is preferable that the central axes of the holes lie in substantially the same transverse plane.

Valve means 60 is annularly disposed between mandrel means 58 and case means 56, and, in the preferred embodiment, the valve means comprises a substantially annular piston 114 biased upwardly by biasing means, such as spring 116, as will be further discussed herein.

Piston 114 defines a central bore 118 therethrough which is in close space relationship with outer surface 98 of upper portion 96 of mandrel means 58. Piston 114 includes a first, upper portion 120 with an outer surface 122 in close spaced relationship to central bore 80 of piston case 66 of case means 56, and piston 114 further includes a second, lower portion 124 with an outer surface 126 in close spaced relationship to first bore 82 of lower adapter 72 of case means 56. The lower end of upper portion 120 of piston 114 forms a downwardly facing shoulder 128 which generally faces shoulder 90 in case means 56.

Shoulders 128 and 90 and outer surface 126 of piston 114 and inner surface 80 of piston case 66 form the boundaries of an annular spring chamber 130. Transverse hole 94 in piston case 66 provides communication between spring chamber 130 and well annulus 46. Spring 116 is disposed in spring chamber 130 and bears against shoulders 90 and 128, thus upwardly biasing piston 114 with respect to case means 56.

The upwardmost position of piston 114, shown in FIG. 2, is defined when upper end 132 of piston 114 engages shoulder 88 in case means 56. Downward movement of piston 114 is limited by the engagement of lower end 134 thereof with upwardly facing shoulder 136 in lower adapter 72 of case means 56.

Upper portion 120 of piston 114 includes transverse passageway means, generally designated by the numeral 138, therethrough. Transverse passageway means 138 preferably includes an outer annular recess 140 and an inner annular recess 142, interconnected by a substantially transverse hole 144. In the uppermost position of piston 114, the central axis of hole 144 is in substantially the same transverse plane as the central axes of hole 112 in mandrel means 58 and hole 92 in piston case 66 of case means 56. Thus, when piston 114 is in the uppermost position shown in FIG. 2, fluid communication is provided between central bore 110 and well annulus 44 through hole 112, annular recess 142, hole 144, annular recess 140 and hole 92. It will be clear to those skilled in the art that, because of recesses 140 and 142, holes 112, 144 and 92 need not be coaxial to provide such fluid communication between central bore 110 and well annulus 44, although the holes are illustrated in coaxial alignment in FIG. 2 for clarity.

Upper portion 120 of piston 114 also includes substantially longitudinal passageway means, generally designated by the numeral 146, therethrough. Longitudinal passageway means 146 is angularly spaced from transverse passageway means 138 about a longitudinal center line of piston 114, and includes a longitudinal hole 148 intersected at the lower end thereof by at least one transverse hole 150. An annular recess 152 in upper end 132 of piston 114 is in communication with the upper end of longitudinal hole 148 so that shoulder 88 cannot close off the upper end of longitudinal hole 148. Thus, substantially longitudinal communication is provided by longitudinal passageway means 146 between annular volume 154, between mandrel means 58 and case means 56 above piston 114, and annular volume 156, between mandrel means 58 and piston 114 below upper portion 96 of the mandrel means.

Sealing means are provided for preventing intercommunication between transverse passageway means 138, longitudinal passageway means 146 and spring chamber 130. Preferably, the sealing means comprises a plurality of seals such as O-rings.

An O-ring 158 is positioned on mandrel means 58 at a position above annular recess 142 in piston 114 when the piston is in the uppermost position shown in FIG. 2. Another O-ring 160 is disposed on mandrel means 58 below annular recess 142. An additional O-ring 162 is mounted on mandrel means 58 at a position below O-ring 160. The longitudinal separation between O-rings 160 and 162 is approximately the same as the longitudinal separation between O-rings 158 and 160.

An O-ring 164 is positioned on piston 114 at a point below annular recess 140 in the piston. Another O-ring 166 is positioned on piston 114 above annular recess 140. An additional O-ring 168 is mounted on piston 114 above O-ring 166. The longitudinal separation between O-rings 168 and 166 is substantially the same as between O-rings 166 and 164.

An O-ring 170 is mounted on piston 114 at a point below transverse hole 150 of longitudinal passageway means 146. It will be seen that the radially outer end of transverse hole 150 is always sealed between O-rings 164 and 170 regardless of the position of piston 114. Thus, O-ing 170 eliminates the need for plugging the radially outer end of transverse hole 150. An O-ring 172 is positioned on lower adapter 72 of case means 56 and seals against outer surface 126 of lower portion 124 of piston 114. Thus, O-rings 170 and 172 always sealingly separate piston chamber 130 from other portions of string bypass 10.

OPERATION OF THE INVENTION

As already discussed, fluid is bypassed around lower packer 36 through the lower bypass means formed by lower equalizing port 50, equalizing passageway 54 and upper equalizing port 52. This passageway is always open. However, as indicated, it is also desirable to have upper bypass means for bypassing around upper packer 34 because of variations in the diameter of well bore 14. String bypass 10 accomplishes this in the following manner.

Referring again to FIG. 1, porting sub 38 is in communication with central flow passageway 111 of which central bore 110 of mandrel means 58 in string bypass 10 forms a part. As testing apparatus 12 is lowered into well bore 14 on tool string 18, fluid is free to enter central flow passageway 111 through porting sub 38. The fluid flows upwardly through central flow passageway 111 and central bore 110 in string bypass 10. Valve means 60 in string bypass 10 is in the normal, open position shown in FIG. 2 as tool string 18 is run into well bore 14, and fluid is thus free by bypass through transverse hole 112 in mandrel means 58, transverse passageway means 138 in piston 114 and transverse hole 92 in case means 56 to exit into upper portion 46 of well annulus 44. Thus, fluid is bypassed around upper packer 34.

Once testing string 12 is in the desired position with upper packer 34 and lower packer 36 above and below formation 16, respectively, pump 26 is actuated to inflate the packers. Well annulus fluid is pumped through pump 26 downwardly toward the packers in a manner generally known in the art. A portion of the flow channel in testing apparatus 12 through which the pumped fluid travels includes annular volume 154, longitudinal passageway means 146 in piston 114 and annular volume 156 in string bypass 10. It will be seen that, regardless of the position of piston 114, this substantially longitudinal flow passageway is always open and provides constant communication between pump 26 and packers 34 and 36. In other words, longitudinal passageway means 146 is continuously open.

Once upper packer 34 and lower packer 36 are inflated into sealing engagement with well bore 14, testing of well formation 16 cannot be carried out if string bypass 10 is still open and providing communication between central flow passageway 111 and well annlus 44. Therefore, it is necessary to close valve means 60 in string bypass 10 prior to testing. Unlike previous bypass devices which are mechanically closed by manipulation of tool string 18, string bypass 10 is closed hydraulically.

A study of FIG. 2 will show that pump pressure from pump 26 is applied to upper end 132 of piston 114. Well annulus or hydrostatic pressure is applied to downwardly facing shoulder 128 of piston 114. Pump pressure also acts upwardly on lower end 134 of piston 114. The pump pressure on lower end 134 partially balances the pump pressure on upper end 132. Pump pressure thus acts downwardly on a net annular area equal to the area of shoulder 128. It will be seen by those skilled in the art that piston 114 will move downwardly when a downwardly directed force exerted by the differential pressure between pump 26 and well annulus 44 acting upon this net annular area exceeds a force acting upwardly on the piston by spring 116.

Pump pressure gradually increases as packers 34 and 36 begin to inflate. When the pump pressure reaches the level sufficient to overcome spring 116, piston 114 will be moved downwardly to a position corresponding to a closed position of valve means 60. Downward movement of piston 114 is stopped when lower end 134 of the piston contacts shoulder 136 such that annular recess 142 of piston 114 is positioned between and sealed by O-rings 160 and 162. Also, O-ring 166 is positioned below transverse hole 92 in piston case 66, and O-ring 68 is immediately above transverse hole 92. Thus, transverse hole 92 and transverse passageway means 138 are sealingly separated, preventing fluid communication therebetween. In other words, fluid is no longer bypassed around upper packer 34.

O-rings 170 and 172 keep spring chamber 130 sealingly isolated from the rest of string bypass 10. As piston 114 moves downwardly, fluid present in spring chamber 130 is vented to well annulus 44 through transverse hole 94 in piston case 66.

After string bypass 10 is closed, pump 26 is operated as necessary until packers 34 and 36 are inflated as desired. Because string bypass 10 is closed, testing of well formation 16 can then be carried out.

It will be seen that valve means 60 in string bypass 10 will remain closed as long as the pump pressure is sufficiently high. Pump 26 is designed such that this pressure is maintained continuously, even after the pump is stopped, until packers 34 and 36 are released. The deflation of packers 34 and 36 is accomplished by actuating packer bypass 30 through which fluid in the packers is vented to well annulus 44. The pressure in string bypass 10 then becomes essentially equal to well annulus pressure. It will be seen that when this occurs, spring 116 will again move piston 114 upwardly so that valve means 60 is in the original, open position. In this position, testing string 12 may be easily removed from well bore 14 with fluid bypassing through string bypass 10 around upper packer 34 in a reverse direction from that described for running into the well bore.

It will be seen, therefore, that the string bypass of the present invention is well adapted to carry out the ends and advantages mentioned as well as those inherent therein. While a presently preferred embodiment of the apparatus has been described for the purpose of this disclosure, numerous changes in the arrangement and construction of parts may be made by those skilled in the art. All such changes are encompassed within the scope and spirit of the appended claims.

What is claimed is:

1. A bypass apparatus for use in a testing string having a pump and a packer, said apparatus comprising:

case means for positioning in said testing string between said pump and packer, said case means defining a transverse port therein in communication with a well annulus;

valve means disposed in said case means for moving between an open position and a closed position, said valve means having first passageway means thereon for providing communication between a central bore of said testing string and said port when said valve means is in said open position and for preventing said communication when said valve means is in said closed position; and second passageway means for providing communication between said pump and said packer.

2. The apparatus of claim 1 wherein said valve means comprises:

a reciprocating piston; and biasing means for biasing said piston toward said open position of said valve means.

3. The apparatus of claim 2 wherein said piston comprises an annular area thereon, wherein said piston is moved from said open position to said closed position of said valve means when a differential between pump pressure and well annulus pressure across said annular area is greater than a force exerted by said biasing means.

4. The apparatus of claim 2 wherein:

said piston and case means define a chamber therebetween vented to said well annulus in which said biasing means is disposed; and further comprising sealing means for sealingly separating said chamber from said first and second passageway means.

5. The apparatus of claim 1 wherein:

said first passageway means is a substantially transverse passageway means; and said second passageway means is a substantially longitudinal passageway means.

6. The apparatus of claim 1 further comprising mandrel means disposed in said case means for defining an annular cavity therebetween, and wherein said valve means is annularly disposed in said cavity.

7. A bypass apparatus for use in a well testing string between a packer inflation pump and an inflatable packer, said apparatus comprising:

an elongated case defining a transverse hole therethrough;

a mandrel having a transverse hole therethrough disposed in said case, said mandrel and case defining an annular cavity therebetween;

a piston defining a passageway therethrough and reciprocably disposed in said annular cavity, said piston having an open position wherein said passageway provides communication between said hole in said mandrel and said hole in said case and further having a closed position, and said piston comprising:

a first portion; and a second portion such that an annular shoulder extends between said first and second portions; and biasing means for biasing said piston toward said open position;

wherein, said piston is movable from said open position toward said closed position when a differential pressure between said pump and a well annulus acting on a net annular area corresponding to an annular area of said shoulder is greater than a force exerted on said piston by said biasing means.

8. The apparatus of claim 7 wherein:

an axis of said hole in said mandrel is in approximately a same transverse plane as an axis of said hole in said case; and said passageway is transversely disposed through said piston.

9. The apparatus of claim 7 wherein said piston further defines a second passageway therethrough for providing communication between an upper portion of said annular cavity above said piston and a lower portion of said annular cavity below said piston.

10. The apparatus of claim 9 further comprising sealing means for sealingly separating said first-mentioned passageway and said second passageway.

11. The apparatus of claim 7 wherein:

said case includes an annular shoulder therein generally facing said annular shoulder on said piston; and said biasing means is characterized by a spring disposed between said annular shoulders.

12. The apparatus of claim 11 wherein:

said case and piston define a spring cavity therebetween, said shoulders forming a portion of a boundary of said spring cavity;

said case further defines a port therethrough providing communication between said spring cavity and said well annulus; and said apparatus further comprises sealing means for sealingly separating said spring cavity from portions of said annular cavity above and below said piston.

13. The apparatus of claim 7 further comprising shoulder means in said case for limiting movement of said piston in said annular cavity.

14. A downhole testing tool having a central flow passageway therethrough and comprising:

a pump attached to an upper testing string portion;

an inflatable packer disposed below said pump and positionable adjacent a well formation to be tested;

a porting sub adjacent said formation and providing communication between said formation and said central flow passageway; and a string bypass disposed between said pump and packer, said string bypass comprising:

first passageway means for providing fluid communication between said central flow passageway and a well annulus above said packer when said first passageway means is open, such that fluid in a well annulus below said packer will be bypassed around said packer as said tool is run into a well bore;

valve means for opening said first passageway means for providing said fluid communication and closing said first passageway means in response to pumping pressure from said pump for preventing such bypassing of fluid; and second passageway means for providing communication between said pump and said packer.

15. The apparatus of claim 14 wherein: said string bypass further comprises:

a case with a hole opening into said well annulus; and a mandrel disposed in said case and having a hole opening into said central flow passageway; and said valve means comprises:

a piston annularly disposed between said case and mandrel, wherein said first passageway means is characterized by a substantially transverse passageway defined through said piston providing communication between said hole in said case and said hole in said mandrel when said valve means is open, said transverse passageway being spaced from said holes when said valve means is closed; and biasing means for biasing said piston open.

16. The apparatus of claim 15 wherein said second passageway means is characterized by a substantially longitudinal passageway defined through said piston, said longitudinal passageway providing continuous communication between said pump and said packer regardless of the position of said piston.

17. The apparatus of claim 16 further comprising sealing means for sealingly separating said longitudinal passageway from said transverse passageway and said holes.

18. The apparatus of claim 15 wherein:

said case and piston defines an annular spring chamber therebetween; and said biasing means is characterized by a spring positioned in said spring chamber.

19. The apparatus of claim 18 further comprising sealing means for sealingly separating said piston chamber from said passageway and said holes.

20. The apparatus of claim 18 wherein said piston chamber is vented to said well annulus.

* * * * *